US009216837B2

(12) United States Patent
Hubbard et al.

(10) Patent No.: US 9,216,837 B2
(45) Date of Patent: Dec. 22, 2015

(54) FOOD TRAY

(75) Inventors: James Hubbard, Oak Lawn, IL (US); Matthew R. Cook, Hinsdale, IL (US); Thomas Fu, Naperville, IL (US)

(73) Assignee: LBP Manufacturing LLC, Cicero, IL (US)

( * ) Notice: Subject to any disclaimer, the term of this patent is extended or adjusted under 35 U.S.C. 154(b) by 963 days.

(21) Appl. No.: 13/165,346

(22) Filed: Jun. 21, 2011

(65) Prior Publication Data

US 2011/0308991 A1 Dec. 22, 2011

Related U.S. Application Data

(60) Provisional application No. 61/356,847, filed on Jun. 21, 2010.

(51) Int. Cl.
*B65D 5/24* (2006.01)
*B65D 5/28* (2006.01)
(Continued)

(52) U.S. Cl.
CPC ..... *B65D 5/2047* (2013.01); *B65D 5/2052* (2013.01); *B65D 5/2057* (2013.01); *B65D 5/24* (2013.01); *B65D 5/28* (2013.01); *B65D 5/6605* (2013.01); *B65D 5/6614* (2013.01); *B65D 5/6644* (2013.01)

(58) Field of Classification Search
CPC .. B65D 5/2052; B65D 5/6605; B65D 5/6614; B65D 5/2047; B65D 5/2057; B65D 5/24; B65D 5/28; B65D 5/6644
USPC ..... 229/141, 142, 143, 148, 149, 150, 127, 229/128, 117.15
See application file for complete search history.

(56) References Cited

U.S. PATENT DOCUMENTS 292,654 A 1/1884 Jaeger
306,532 A 10/1884 Schmidt
(Continued)

FOREIGN PATENT DOCUMENTS

EP 657359 9/1998
GB 693179 6/1953
(Continued)

OTHER PUBLICATIONS

Photo of food box believed to have been taken prior to Jun. 21, 2010.
(Continued)

*Primary Examiner* — Gary Elkins
(74) *Attorney, Agent, or Firm* — Fitch, Even, Tabin & Flannery LLP

(57) ABSTRACT

A food tray includes a front wall with a distal end and a proximal end, and a rear wall with a distal end and a proximal end. A first sidewall extends between the distal end of the front wall and the distal end of the rear wall, and a second sidewall that extends between the proximal end of the front wall and the proximal end of the rear wall. The front wall, rear wall, first sidewall, and second sidewall define an opening through which an item is placed in the food tray. The first and second sidewalls each define a slot and an extension extending above the slot. A lid member extends from a top edge of the front wall and defines a pair of tabs that engage the slots defined by the first and second sidewalls when the lid is folded over the opening. The top edge of the front wall is configured to cause the lid member to open when the first and second sidewall extensions are pulled apart.

22 Claims, 12 Drawing Sheets

(51) Int. Cl.

| | |
|---|---|
| ***B65D 5/66*** | (2006.01) |
| ***B65D 5/20*** | (2006.01) |

(56) References Cited

U.S. PATENT DOCUMENTS

| | | | | | |
|---|---|---|---|---|---|
| 667,634 | A | * | 2/1901 | Schmidt | 229/128 |
| 926,208 | A | | 6/1909 | Palmer | |
| 1,440,233 | A | | 12/1922 | Noel | |
| 2,110,681 | A | | 3/1935 | Rutledge | |
| 2,072,753 | A | | 7/1935 | Ikeda | |
| 2,361,124 | A | | 9/1942 | Ringholz | |
| 2,330,521 | A | | 9/1943 | Scheioe | |
| 2,805,813 | A | | 9/1957 | Rittmueller | |
| 2,909,105 | A | * | 10/1959 | Lawrence | 493/137 |
| 3,105,626 | A | | 10/1963 | McCormick | |
| 3,126,142 | A | | 3/1964 | Goetz | |
| 3,176,899 | A | | 4/1965 | McMahon | |
| 3,343,660 | A | * | 9/1967 | Bailey | 229/114 |
| 3,670,949 | A | * | 6/1972 | Galanes | 229/120 |
| 3,809,310 | A | * | 5/1974 | VanderLugt, Jr. | 229/110 |
| 3,949,931 | A | * | 4/1976 | Hall | 229/102 |
| D259,615 | S | | 6/1981 | Morris, Jr. | |
| 4,291,806 | A | * | 9/1981 | Austin | 229/120 |
| 4,747,536 | A | * | 5/1988 | Wischusen, III | 229/128 |
| 4,917,291 | A | | 4/1990 | Saiki | |
| 5,226,588 | A | * | 7/1993 | Schramm et al. | 229/149 |
| D348,607 | S | | 7/1994 | Young | |
| 5,370,303 | A | * | 12/1994 | Fry | 229/143 |
| 5,411,204 | A | | 5/1995 | DeMay | |
| 5,431,333 | A | | 7/1995 | Lorenz | |
| 5,620,134 | A | * | 4/1997 | Gulliver | 229/117.14 |
| 5,800,061 | A | | 9/1998 | Volles | |
| 6,036,085 | A | | 3/2000 | Tsao | |
| 6,050,483 | A | | 4/2000 | Haraldsson et al. | |
| 6,223,979 | B1 | | 5/2001 | Correll | |
| 6,543,679 | B2 | | 4/2003 | Cai et al. | |
| 6,676,010 | B1 | | 1/2004 | Roseth | |
| D495,251 | S | | 8/2004 | Zack | |
| D519,366 | S | | 4/2006 | Epstein | |
| D552,987 | S | | 10/2007 | Magnusson | |
| 7,587,883 | B2 | | 9/2009 | Cook et al. | |
| 7,980,452 | B2 | | 7/2011 | Burton | |
| 8,109,433 | B2 | * | 2/2012 | De Paula et al. | 229/101 |
| 2004/0178252 | A1 | * | 9/2004 | Stone et al. | 229/116.1 |
| 2004/0182916 | A1 | | 9/2004 | Roseth | |
| 2010/0065620 | A1 | | 3/2010 | Smith | |

FOREIGN PATENT DOCUMENTS

| | | | | | |
|---|---|---|---|---|---|
| GB | 2427399 | A | * | 12/2006 | B65D 5/0209 |
| WO | 2008001650 | | | 1/2008 | |

OTHER PUBLICATIONS

Examination Report issued in related Canadian Application No. 2,780,514 dated May 28, 2015 (3 pages).

* cited by examiner

FOOD TRAY

RELATED APPLICATIONS

This application claims priority to U.S. Provisional Application No. 61/356,847, filed Jun. 21, 2010, the contents of which are hereby incorporated by references.

BACKGROUND

Typical food trays are made from a single piece of cardboard that is folded Food trays are utilized to package food items. For example, a fast-food restaurant may package a hamburger in a food tray. A caterer catering to an office may place a sandwich, a bag of chips, and a cookie in a food tray.

Typical food trays are made from a single piece of cardboard that is folded into a configuration that provides a container with a lid. The container is sized to protect the food item during handling. The lid typically includes locking tabs that engage complementary locking tabs on the container when the lid is closed.

One problem with food trays is that they can tend to get soggy due to the humidity and heat produced by the food item. Another problem is that the lid may have a tendency to move into the closed position after being opened due to the elastic nature of the cardboard.

BRIEF SUMMARY

A food tray includes a front wall with a distal end and a proximal end, and a rear wall with a distal end and a proximal end. A first sidewall extends between the distal end of the front wall and the distal end of the rear wall, and a second sidewall extends between the proximal end of the front wall and the proximal end of the rear wall. The front wall, rear wall, first sidewall, and second sidewall define an opening through which an item is placed in the food tray. The first and second sidewalls each define a slot and an extension extending above the slot. A lid member extends from a top edge of the front wall and defines a pair of tabs that engage the slots defined by the first and second sidewalls when the lid is folded over the opening. The top edge of the front wall is configured to cause the lid member to open when the first and second sidewall extensions are pulled apart.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION OF THE DRAWINGS

The exemplary embodiments below describe a food tray for storing and/or serving a food item. The food tray includes a first lid member and second lid member that are attached to a front wall and rear wall, respectively. The edges between the respective lid members and walls are bowed so that tension is produced in the front wall and rear wall when the respective lid members are placed in a closed configuration. The lid members are held in place by a group of tabs that engage a pair of slots in first and second side walls of the food tray. The slots and tabs cooperate to prevent the lid members from opening under the tension. When the first and second sidewalls are spread apart, the tabs are released from the slots, and tension in the front and rear walls causes the lid members to automatically open.

Figure 1:
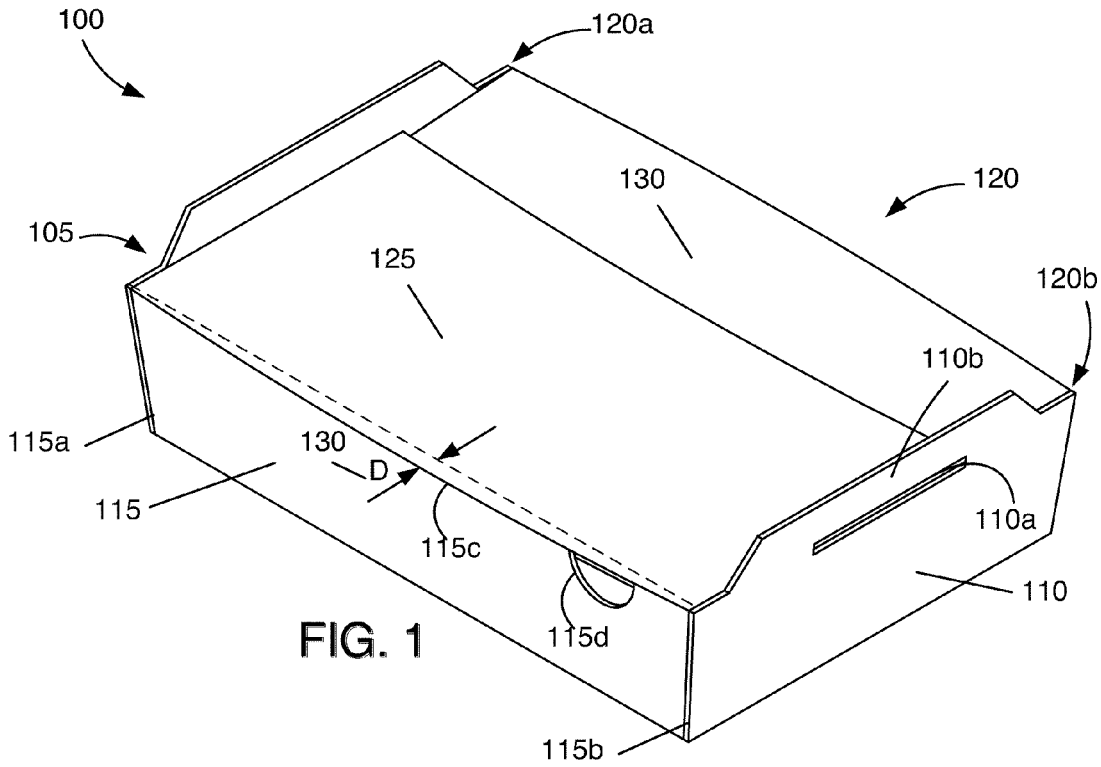
FIG. 1 illustrates a perspective view of a food tray.

FIG. 1 illustrates a perspective view of a food tray 100. The food tray 100 includes a first sidewall 105, a second sidewall 110, a front wall 115, a rear wall 120, a first lid member 125, and a second lid member 130. The first sidewall 105 extends between the distal end 115*a* of the front wall 115 and the distal end 120*a* of the rear wall 120. The second sidewall 110 extends between the proximal end 115*b* of the front wall 115 and the proximal end 120*b* of the rear wall 120.

Figure 6:
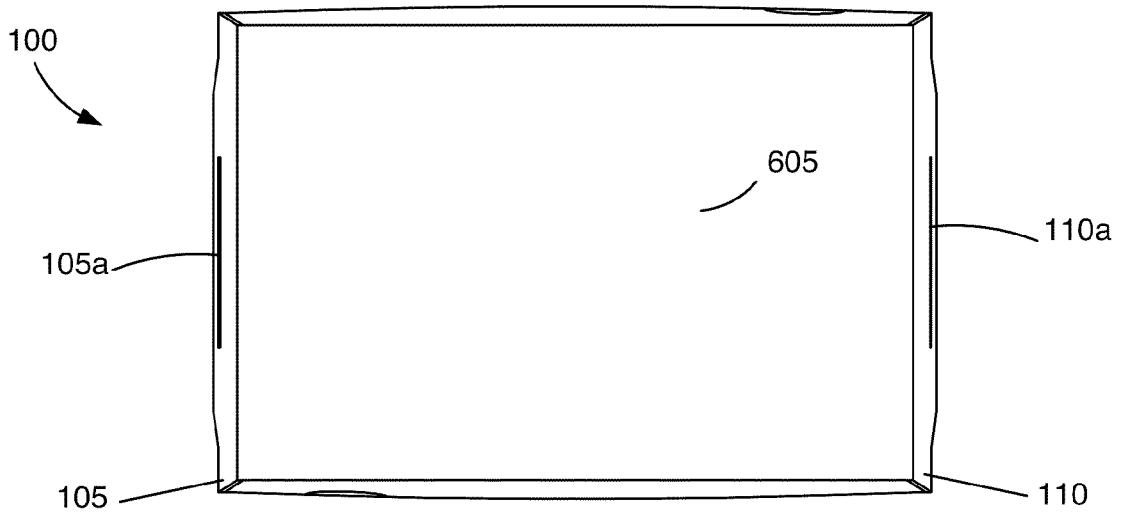

A bottom surface 605 (FIG. 6) extends between respective bottom edges of the first side wall 105, second side wall 110, front wall 115, and rear wall 120 to define the bottom of the food tray 100. Respective top edges of the first sidewall 105, second sidewall 110, front wall 115, and rear wall 120 define an opening through which a food item may be placed in the food tray 100.

In some implementations, the first sidewall 105, second sidewall 110, front wall 115, and rear wall 120 are tapered to enable stacking of the food tray 100. For example, the angle between each respective wall and a line that is normal to the bottom surface 605 of the food tray may be greater than 0°.

In yet other implementations, the front wall 115 and/or the rear wall 120 define openings 115*d* and 120*d* that enable venting the food tray. The openings 115*d* and 120*d* may be defined by way of perforated edges that enable a user to push out or otherwise remove a portion of the front wall 115 and/or the rear wall 120 to reveal the openings 115*d* and 120*d*.

Figure 7:
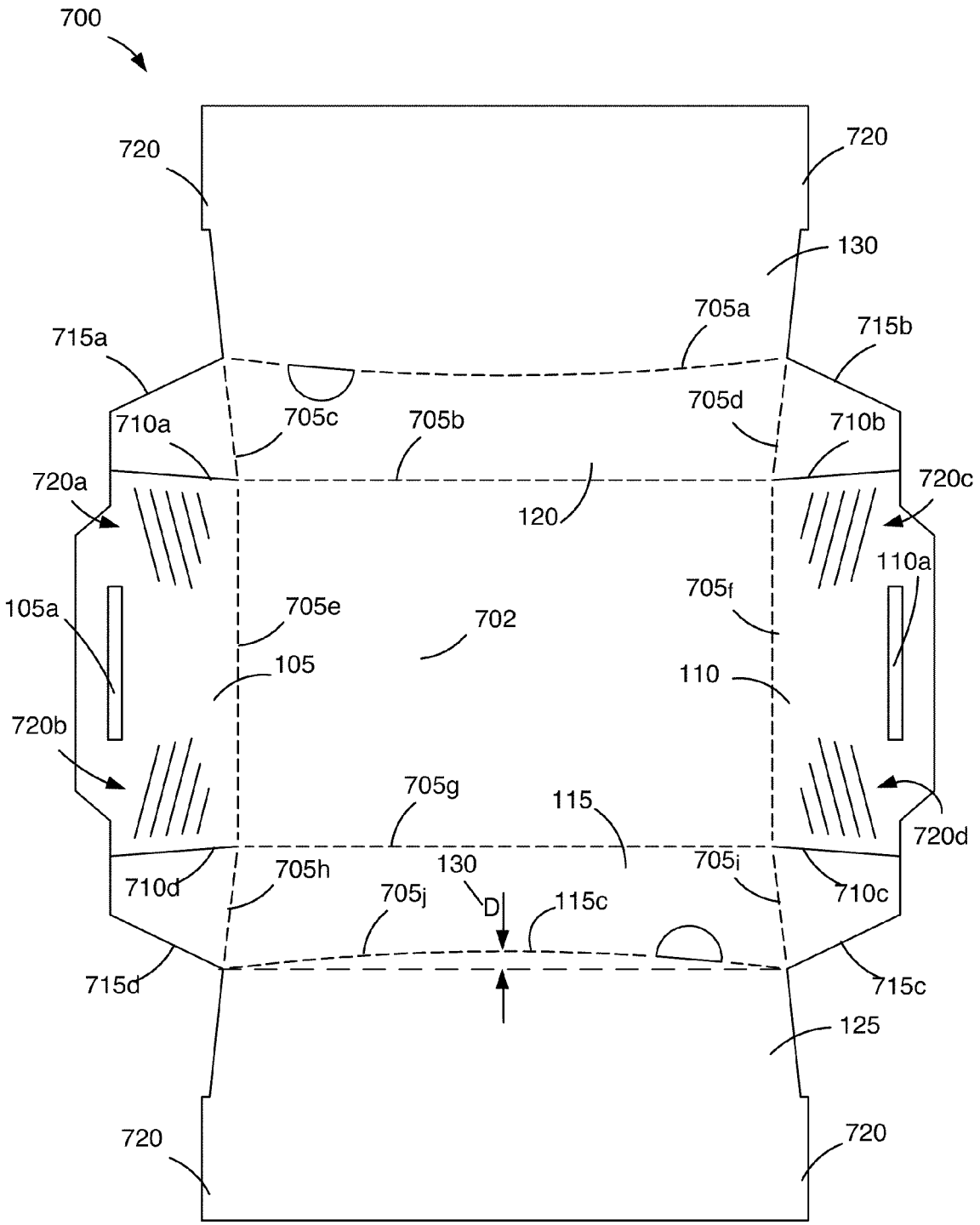
FIG. 7 illustrates a sheet that defines the various members of the food tray of FIG. 1 in an unassembled configuration.

The first lid member 125 extends from the top edge of the front wall 115, and the second lid member 130 extends from the top edge of the rear wall 120, as shown in FIG. 1 and more clearly in FIG. 7.

As shown in FIG. 7, the first lid member 125 and the second lid member 130 each define a pair of tabs 720 that are configured to engage the slots 105*a* and 110*a* defined by the first and second side walls 105 and 110 when the respective lid members 125 and 130 are folded to cover the opening. The length of the tabs 720 may be configured to match the length of the slots 105*a* and 110*a* so that when the lid members 125 and 130 are folded to cover the opening, the lid members 125 and 130 are substantially prevented from moving in a lateral direction.

Figure 2:
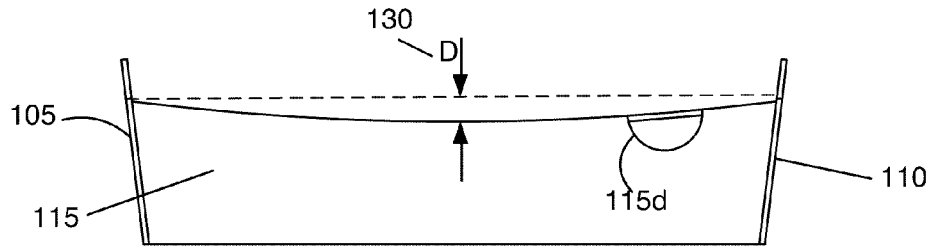
FIGS. 2 and 3 illustrate front and back views, respectively, of the food tray of FIG. 1.
Figure 3:
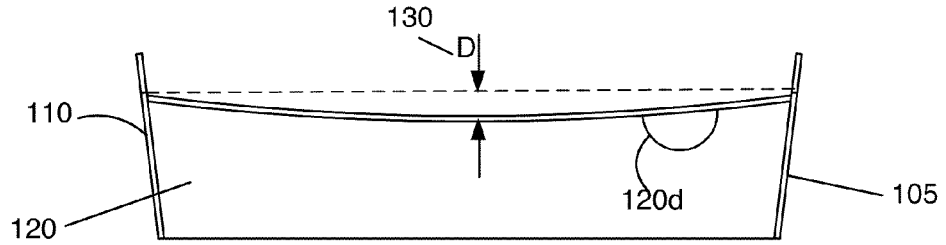
Figure 4:
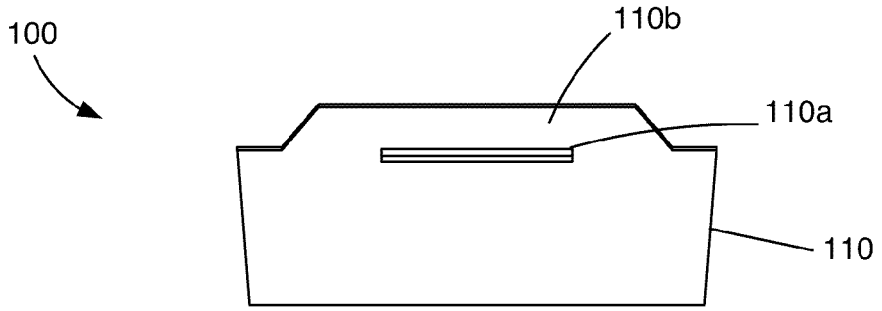
FIG. 4 illustrates a side view of the food tray of FIG. 1.
Figure 5:
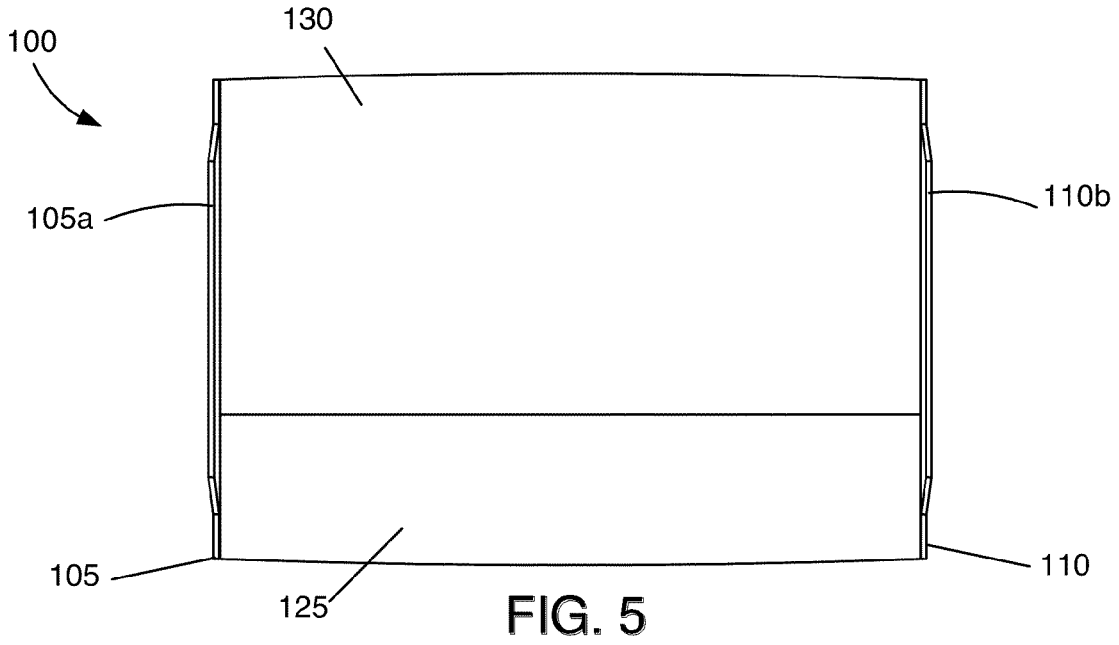
FIGS. 5 and 6 illustrate top and bottom views, respectively, of the food tray of FIG. 1.

As illustrated by FIGS. 1-3, when the first lid member 125 is closed, the front wall 115 is bowed so that a center region of the top edge 115*c* of the front wall 115 is spaced apart from a line that extends between the distal end 115*a* and the proximal end 115*b* by a distance D 130. For example, the distance D 130 may correspond to about 0.5 inches or a different distance. In some embodiments, the rear wall 120 is bowed in a similar manner when the second lid member 130 is closed.

Bowing of the front wall 115 and the rear wall 120 provides an elastic force that causes the first and second lid members 125 and 130 to open on their own when the extensions 105*b* and 110*b* on the first and second side walls 105 and 110 are pulled apart to release the tabs 720 on the first and the second lid members 125 and 130. Stated differently, when the first and second lid members 125 and 130 are in an open position, the first and second lid members 125 and 130 lie in the same plane as the front wall and rear wall 115 and 120, respectively. In this configuration, the front wall 115 and the rear wall 120 may be generally planar and not bowed. When the first and second lid members 125 and 130 are moved into the closed configuration, tension is produced in the front wall 115 and the rear wall 120 by way of the bowing that occurs in the front wall 115 and the rear wall 120 resulting from the arc shape crease 705*a* and 705*j* (FIG. 7) that defines the separation of the first lid member 125 from the front wall 115 and the second lid 130 member from the rear wall 120. This tension causes the respective lid members 125 and 130 to automatically open when the tabs 720 are released from the slots.

As illustrated in FIG. 7, the food tray may be formed from a single sheet 700 of material, such as a corrugated paper material. The sheet 700 may define a group of creases 705*a-j* that further define the first side wall 105, second side wall 110, front wall 115, rear wall 120, first lid member 125, and second lid member 130.

In one embodiment, the food tray is configured by cutting the sheet along a group of cut lines 710 *a-d* to separate a group of tabs 715*a-d*. Next, the sheet 700 is folded along the group of creases 705*a-j* to configure the food tray. The configuration is maintained by attaching the group of tabs 715*a-d* to the first sidewall and second sidewall. The tabs 715*a-d* may be attached to the first sidewall and second sidewall via glue strips 720*a-d* disposed on the first and second sidewalls, or in a different matter.

Figure 8A:
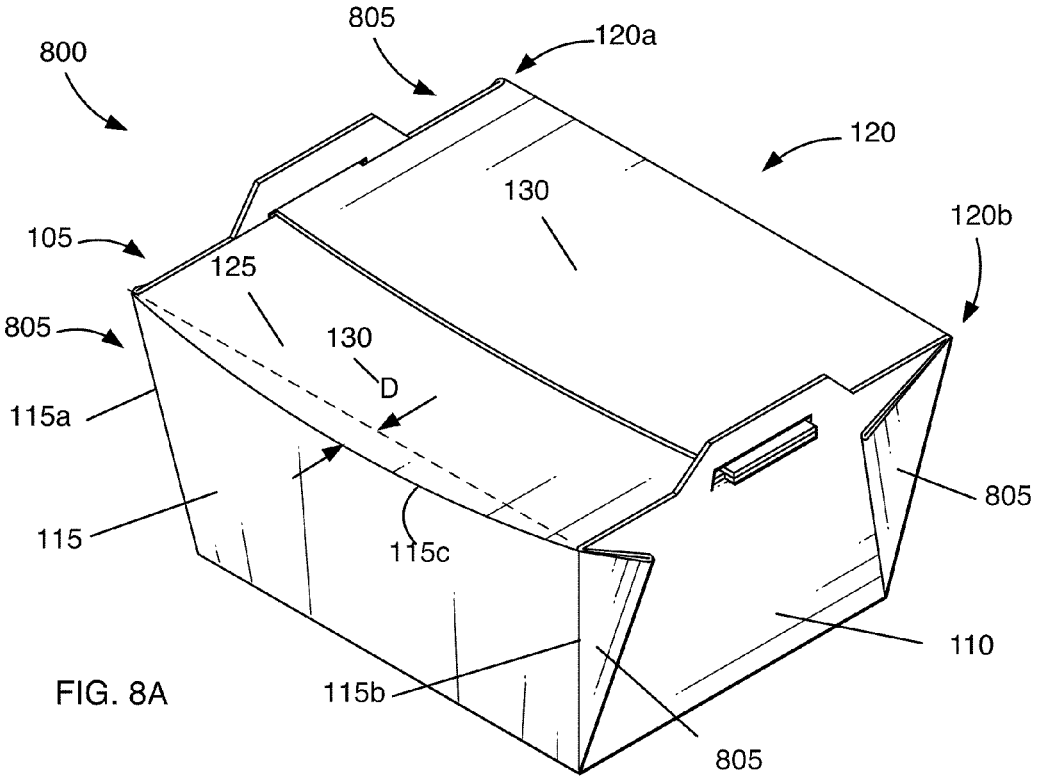
FIG. 8A illustrates a perspective view of a third embodiment of a food tray.

FIG. 8A is another of a food tray 800. The food tray 800 includes a first sidewall 105, a second sidewall 110, a front wall 115, a rear wall 120, a first lid member 125, and a second lid member 130. The respective walls and lid members may be sized and positioned relative to one another in a similar manner as the respective walls and lid members of the food tray 100 in FIG. 1. The food tray 800 may be combined with any other elements of the food tray 100 described above.

Figure 8B:
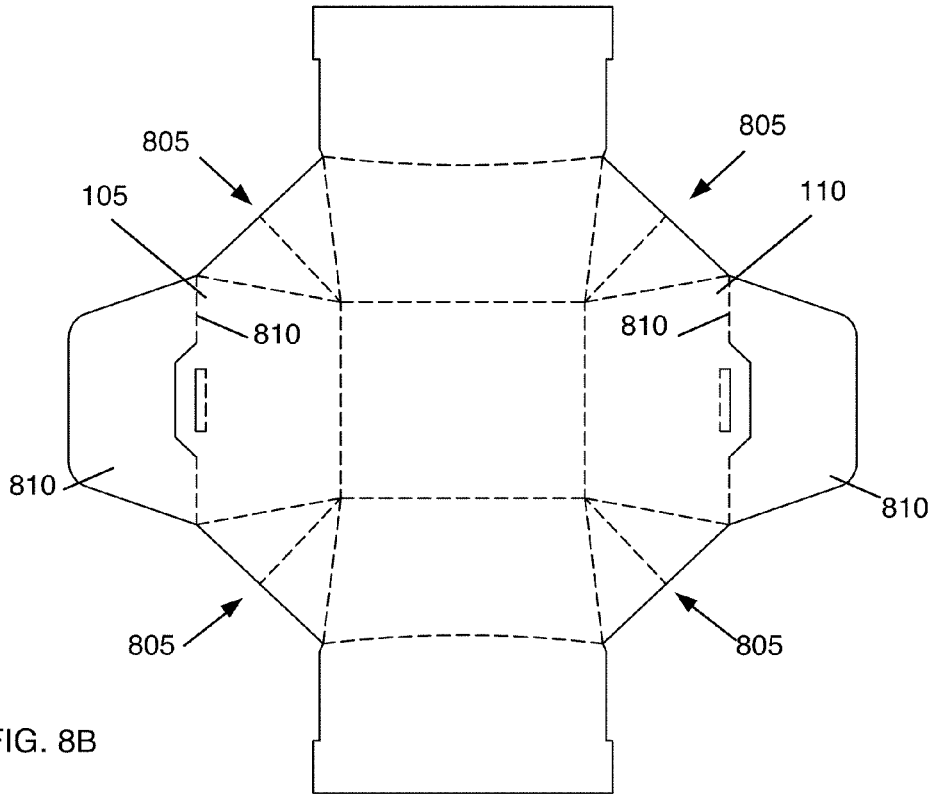
FIG. 8B illustrates the food tray of FIG. 8A in an unassembled configuration.

The food tray 800 includes a group of gussets 805 on respective corners of the food tray 800. In FIG. 8B, the gussets 805 are integrally formed with the first sidewall 105, second sidewall 110, front wall 115, and rear wall 120, respectively. The gussets 805 enable the food tray 800 to store a fluid substance without spillage. The gussets 805 may be folded so that they are positioned on the outside of the food tray 800, as shown, or on the inside of the food tray 800. The gussets 805 may be folded over the first sidewall 105 and second sidewall 110, as shown, over the front wall 115 and rear wall 120, or any combination thereof. In some implementations, an adhesive may be utilized to secure the gusset 805 to the respective sidewall. The adhesive may be pre-applied to the respective walls or the gussets 805 to enable quick assembly of the food tray 800 in a restaurant setting. The gussets 805 may also be fastened differently as described below.

In FIG. 8B, a folding portion 810 may extend from the first sidewall 105 and the second sidewall 110, respectively. In operation, the folding portion 810 is folded towards the center of the food tray 800 along a shared edge 810 with the respective sidewall 105 and 110. In this configuration, the folding portion 810 forms a shelf that extends toward the center of the food tray 800. The shelf provides support for the first lid member 130 and the second lid member 125 when the respective lid members 130 and 125 are folded to close the food tray 800.

Figure 9A:
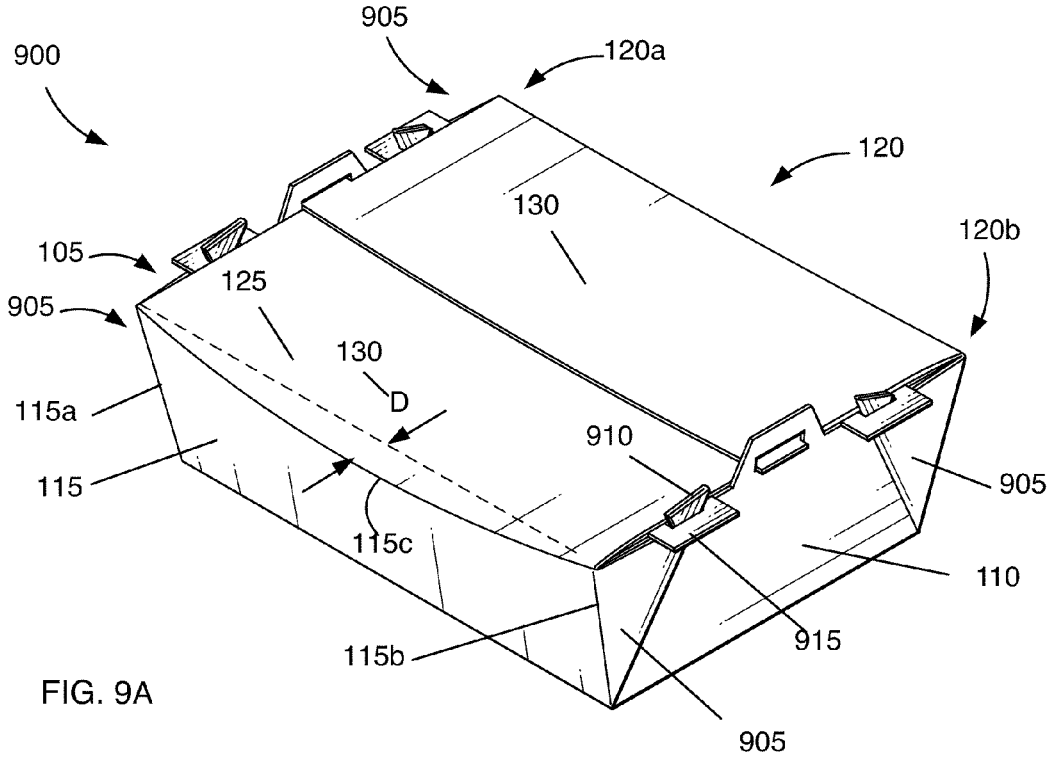
FIG. 9A illustrates a perspective view of a fourth embodiment of a food tray.

FIG. 9A is another embodiment of a food tray 900. The food tray 900 includes a first sidewall 105, a second sidewall 110, a front wall 115, a rear wall 120, a first lid member 125, and a second lid member 130. The respective walls and lid members may be sized and positioned relative to one another in a similar manner as the respective walls and lid members of the food tray 100 in FIG. 1. The food tray 900 may be combined with any other elements of the food tray 100 of FIG. 1 and/or the food tray 800 of FIG. 8, described above.

Figure 9B:
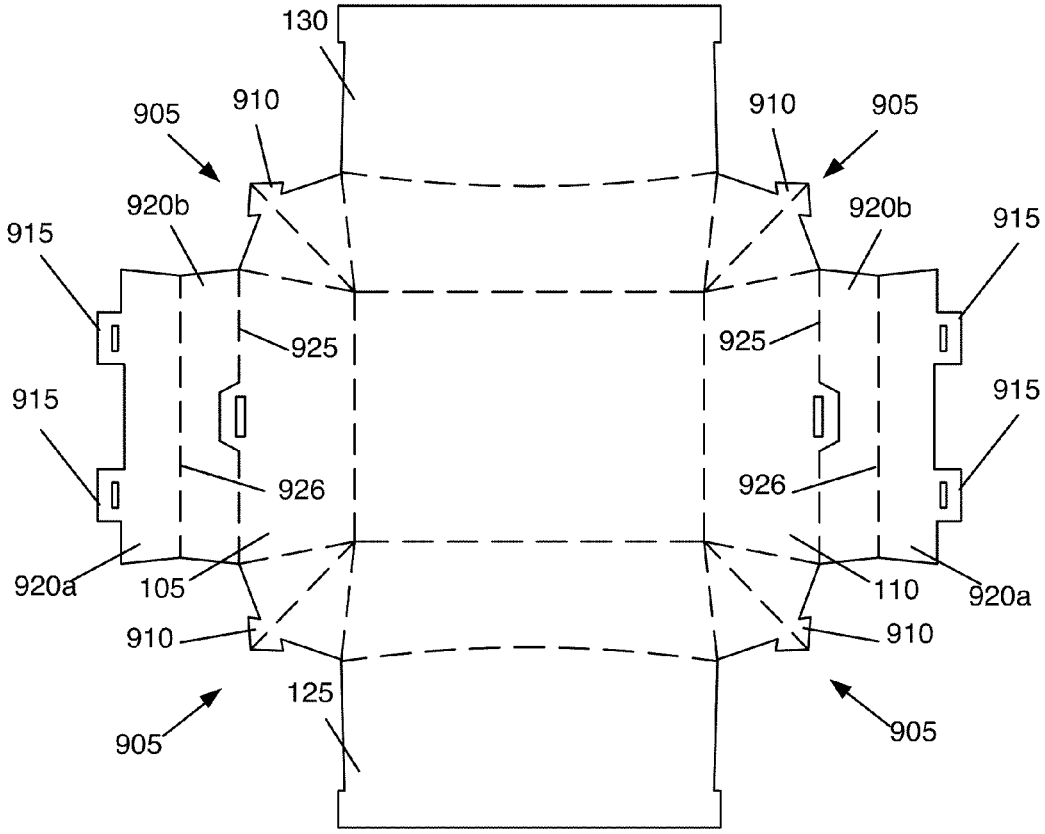
FIG. 9B illustrates the food tray of FIG. 9A in an unassembled configuration.

The food tray 900 includes a group of gussets 905 on respective corners of the food tray 900. In FIG. 9B, the gussets 905 are integrally formed with the first sidewall 105, second sidewall 110, front wall 115, and rear wall 120. The gussets 905 enable the food tray 900 to store a fluid substance without spillage. The gussets 905 may be folded so that they are positioned on the outside of the food tray 900, as shown. The gussets 905 may be folded over the first sidewall 105 and second sidewall 110, as shown, over the front wall 115 and rear wall 120, or any combination thereof.

Each gusset 905 includes a lock tab 910 positioned on a tip of the gusset 905. The lock tab 910 is configured to enter through an aperture defined by a complementary lock tab 910 that extends in a substantially perpendicular direction away from an outside surface of a sidewall 105 and 110 of the food tray 900.

In FIG. 9B, the lock tabs 915 may be integrally formed with the first sidewall 105 and the second side wall 110, respectively. In particular, the respective lock tabs 910 may extend from a first folding portion 920*a* and a second folding portion 920*b* of the first sidewall and the second side wall, respectively.

In operation, the second folding portion 920*b* is folded towards the center of the food tray 900 along a shared edge 925 with the respective sidewall 105 and 110. Next, the first folding portion 920*a* is folded about a shared edge 926 with the second folding portion 920*b*, so that the lock tabs 915 extend over the first sidewall 105 and the second sidewall 110, respectively to engage the lock tabs 910 of the respective gussets 905. The first folding portion 920*a* and the second folding portion 290*b* form a shelf that extends toward the center of the food tray 900. The shelf provides support for the first lid member 125 and the second lid member 130 when the respective lids 125 and 130 are folded to close the food tray 900.

Figure 10A:
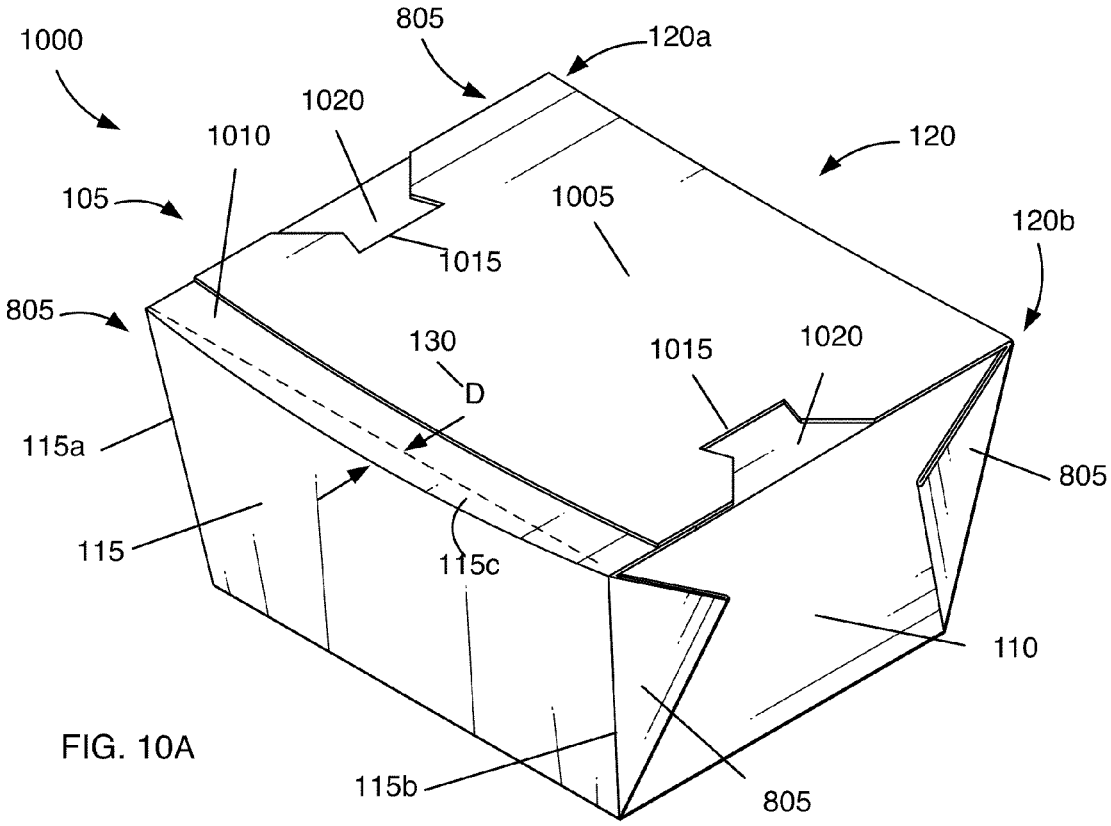
FIG. 10A illustrates a perspective view of a fifth embodiment of a food tray.

FIG. 10A is another embodiment of a food tray 1000. The food tray 1000 includes a first sidewall 105, a second sidewall 110, a front wall 115, a rear wall 120, a first lid member 1005, a second lid member 1010, and a pair of flaps 1025 extending from the first sidewall 105 and the second side wall 110, respectively. The respective walls members may be sized and positioned relative to one another in a similar manner as the respective walls members of the food tray 100 in FIG. 1. The food tray 1000 also includes a group of gussets 805 on corners of the food tray 1000 that may be configured similar to the gussets 805 of the food tray 800 of FIG. 8A. The food tray 1000 may be combined with any other elements of the food tray 100 of FIG. 1, the food tray 800 of FIG. 8A, and/or the food tray 900 of FIG. 9A.

The first lid member 1005 and the second lid member 1010 are configured to be folded to cover a food item placed within the food tray 1000. The first lid member 1005 of the food tray 1000 defines a pair of lock tabs 1020 configured to engage a complementary pair of lock tabs 1015 defined by the flaps 1025 extending from the first sidewall 105 and the second sidewall 110, respectively. The lock tabs 1020 defined by the first lid member 1005 and the lock tabs 1015 defined by the flaps 1025 cooperate to lock the respective lid member 1005 and 1010 in a closed position.

Figure 10B:
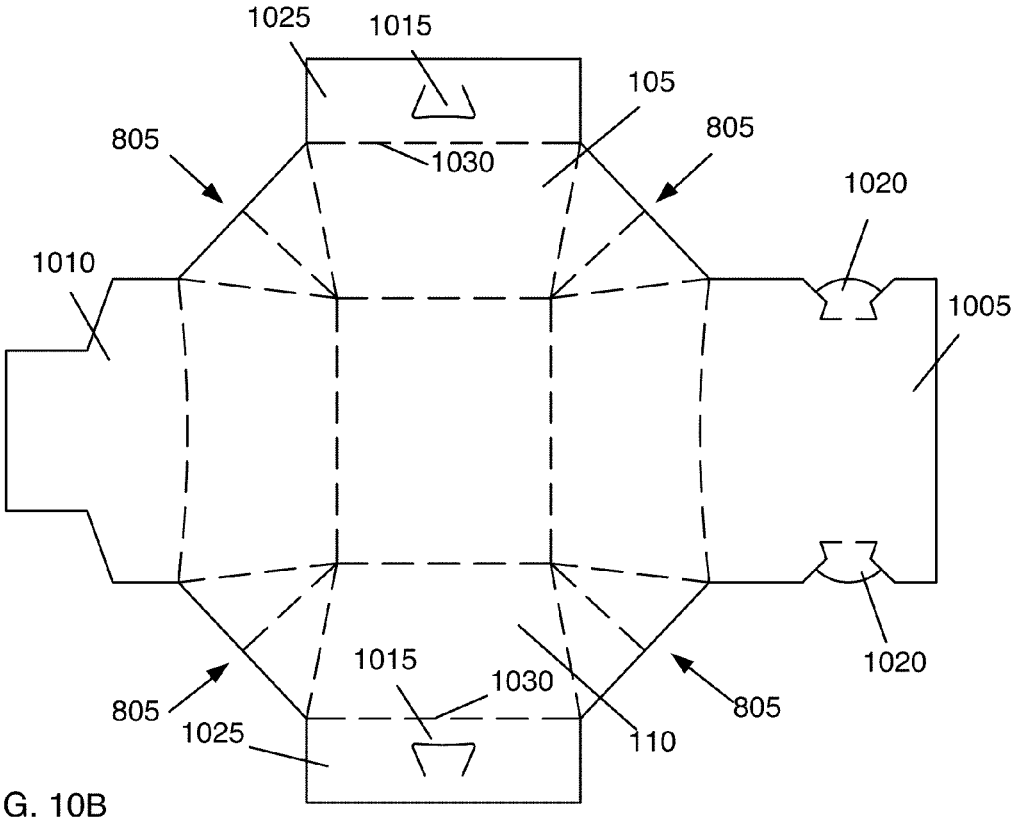
FIG. 10B illustrates the food tray of FIG. 10A in an unassembled configuration.

As shown in FIG. 10B, the lock tabs 1015 may be integrally formed with the flaps 1025.

In operation, in the assembled configuration, the flaps 1025 are folded towards the center of the food tray 1000 along a shared edge 1030 with the respective sidewalls 105 and 110. In this configuration, the flaps 1025 form a shelf that extends toward the center of the food tray 1000. The shelf provides support for the first lid member 1005 and the second lid member 1010 when the respective lid members 1005 and 1010 are folded to close the food tray 1000.

Figure 11A:
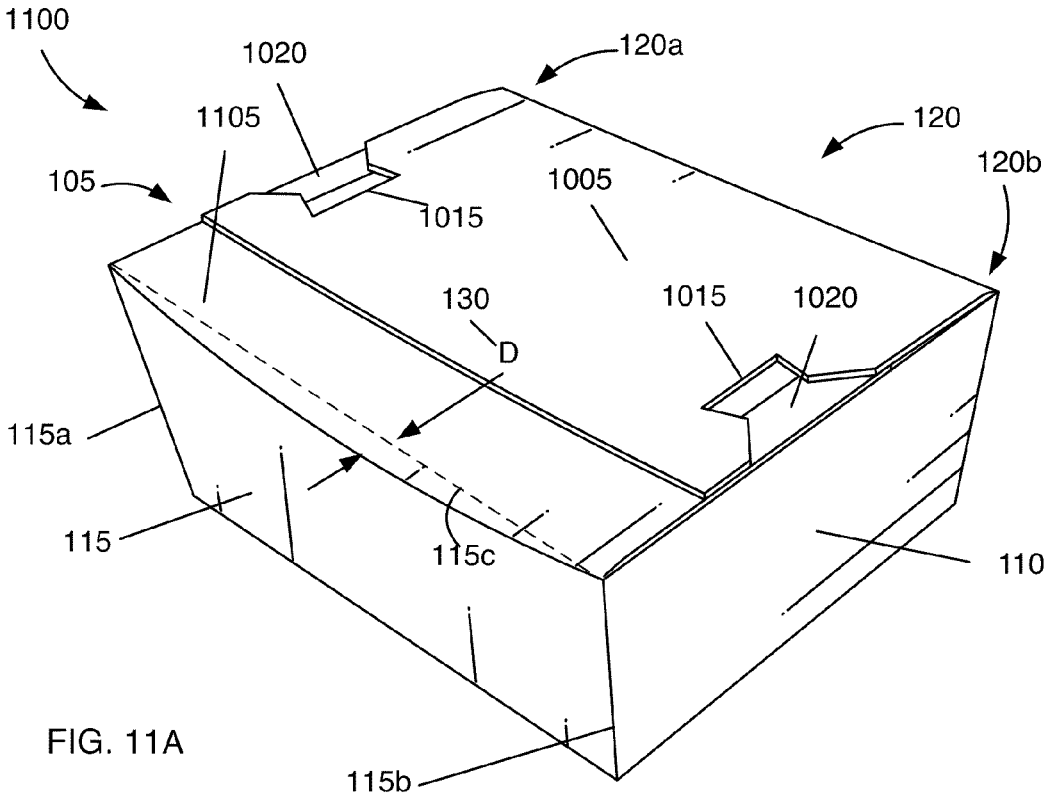
FIG. 11A illustrates a perspective view of a sixth embodiment of a food tray.

FIG. 11A is yet another embodiment of a food tray 1100. The food tray 1100 includes a first sidewall 105, a second sidewall 110, a front wall 115, a rear wall 120, a first lid member 1005, a second lid member 1105, and a pair of flaps 1025. The respective wall members may be sized and positioned relative to one another in a similar manner as the respective wall members of the food tray 1000 in FIGS. 10A and 10B. The food tray 1000 may be combined with any other elements of the food trays described above.

Figure 11B:
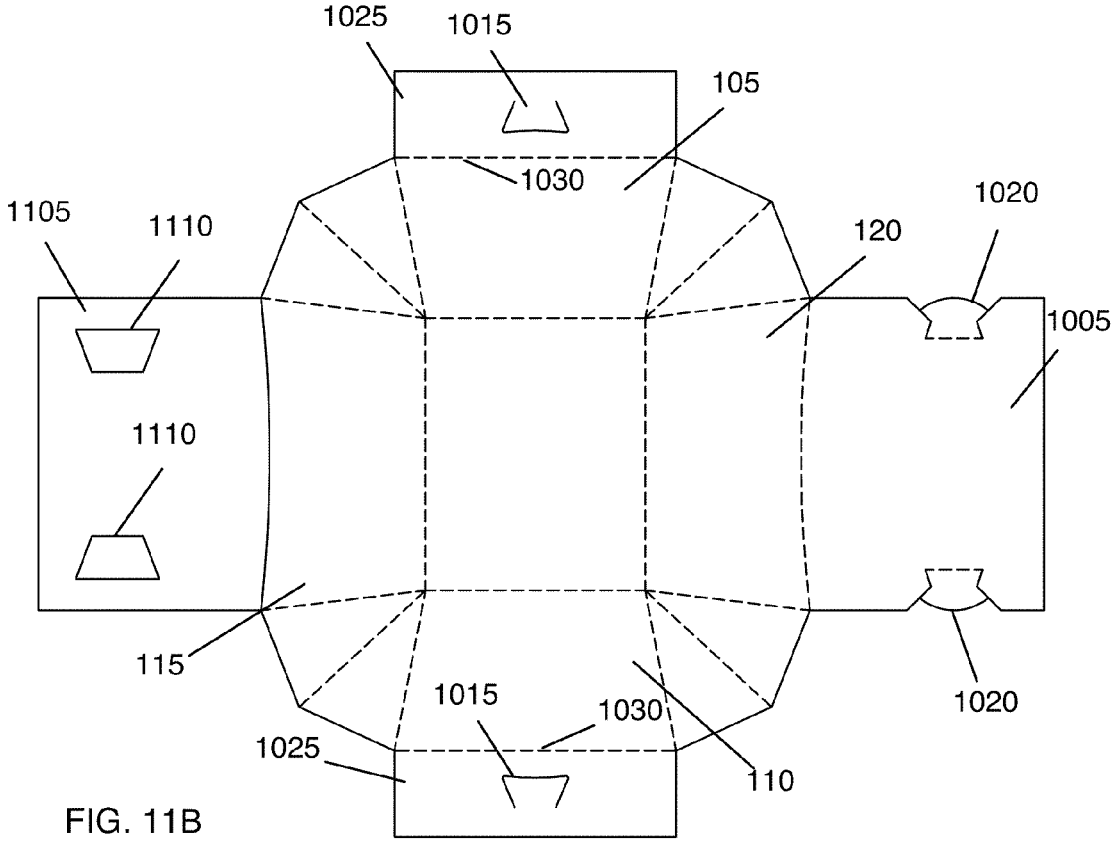
FIG. 11B illustrates the food tray of FIG. 11A in an unassembled configuration.

The first lid member 1005 and the second lid member 1105 are configured to be folded to cover a food item placed within the food tray 1100. The first lid member 1005 of the food tray 1000 defines a pair of lock tabs 1020 configured to pass through a respective pair of openings 1110 (FIG. 11B) defined by the second lid member 1105 to engage a complementary pair of lock tabs 1015 defined by the flaps 1025. The lock tabs 1020 defined by the first lid member 1005 and the lock tabs 1015 defined by the flaps 1025 cooperate to lock the respective lid member 1005 and 1010 in a closed position.

In operation, in the assembled configuration, the flaps 1025 are folded towards the center of the food tray 1000 along a shared edge 1030 with the respective sidewall 105 and 110. Next the second lid member 1105 is folded about a shared edge with the front wall 115. In this configuration, the lock tabs 1015 on the flaps 1025 are positioned below the openings 1110. Next, the first lid member 1005 is folded over the second lid member 1105. The lock tabs 1020 defined by the first lid member 1005 are then inserted through the openings 1110 defined by the second lid member 1105 so as to engage the lock tabs 1015 defined by the flaps 1025. In this configuration, the flaps 1025, first lid member 1005 and second lid member 1105 cooperate to provide a top surface capable of supporting additional food trays 1100. For example, the second lid member 1105 is substantially prevented from being pushed into the cavity of the food tray because the respective locking tabs 1015 and 1020 engage one another by passing through the openings 1110. This, in turn enables the food tray 1100 to support the weight of additional food trays with food items stored therein as is the case when food trays are stacked.

Figure 12A:
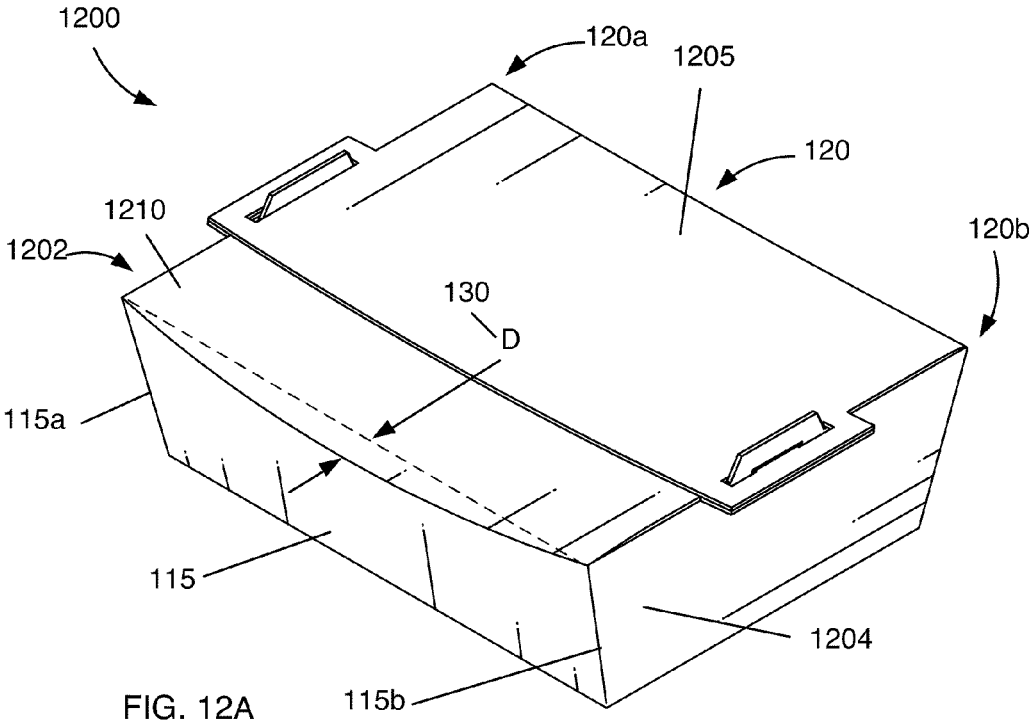
FIG. 12A illustrates a perspective view of a seventh embodiment of a food tray.

FIG. 12A is yet another embodiment of a food tray 1200. The food tray 1200 includes a first sidewall 1202, a second sidewall 1204, a front wall 115, a rear wall 120, a first lid member 1205, and a second lid member 1210. The respective walls members may be sized and positioned relative to one another in a similar manner as the respective walls members of the food tray 100 in FIG. 1. The food tray 1200 may be combined with any other elements of the various food trays described above.

Figure 12B:
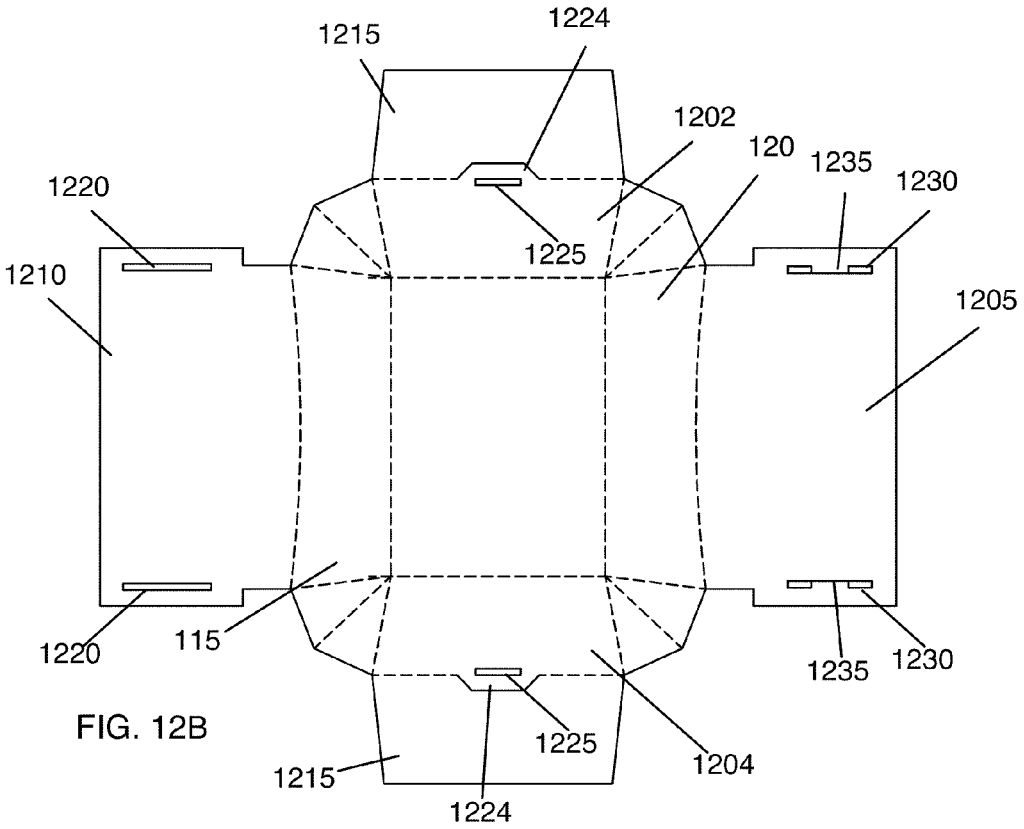
FIG. 12B illustrates the food tray of FIG. 12A in an unassembled configuration.

The first lid member 1205 and the second lid member 1210 are configured to be folded to cover a food item placed within the food tray 1200. Referring to FIG. 12B, the first lid member 1205 defines a pair of slots 1230. Each slot 1230 includes a tab 1235 that extends from one edge of the slot 1230 into a center region of the slot 1230. The second lid member 1220 includes a pair slots 1220 that are configured to overlap the slots 1230 defined by the first lid member 1205 when the first lid member 1205 is folded over the second lid member 1220.

The first sidewall 1202 and the second sidewall 1204 each define an extension section 1224 that defines a slot 1225. A flap 1215 extends from a top edge of the each of the respective sidewalls 1202 and 1204 and is configured to be folded about the top edge.

The extension section 1224 is sized to pass through the slots 1230 and 1220 defined by the first lid member 1205 and the second lid member 1220 when the food tray 1200 is in an assembled configuration, and the respective lid members 1205 and 1210 are folded over one another. The slot 1225 defined by the extension section 1224 is sized to receive the tabs 1235 of the slots 1230 defined by the first lid member 1205, such that when the first lid member 1205 and the second lid member 1210 are folded and the extension section 1224 passes through the respective slots 1230 and 1220 on the respective lid members 1205 and 1210, the tab 1235 extends through the slot 1225 defined by the extension section 1202. In other words, the tab 1235 engages the slot 1225 defined by the extension section 1224 to secure the respective lid members 1205 and 1210 in a closed configuration. Moreover, because the extension section 1224 passes through the slots 1230 and 1220 of both lid members 1205 and 1210, both lid members 1205 and 1210 are prevented from being pushed in when in a closed configuration. This, in turn enables the food tray 1200 to support the weight of additional food trays with food items stored therein as is the case when food trays are stacked.

Figure 13A:
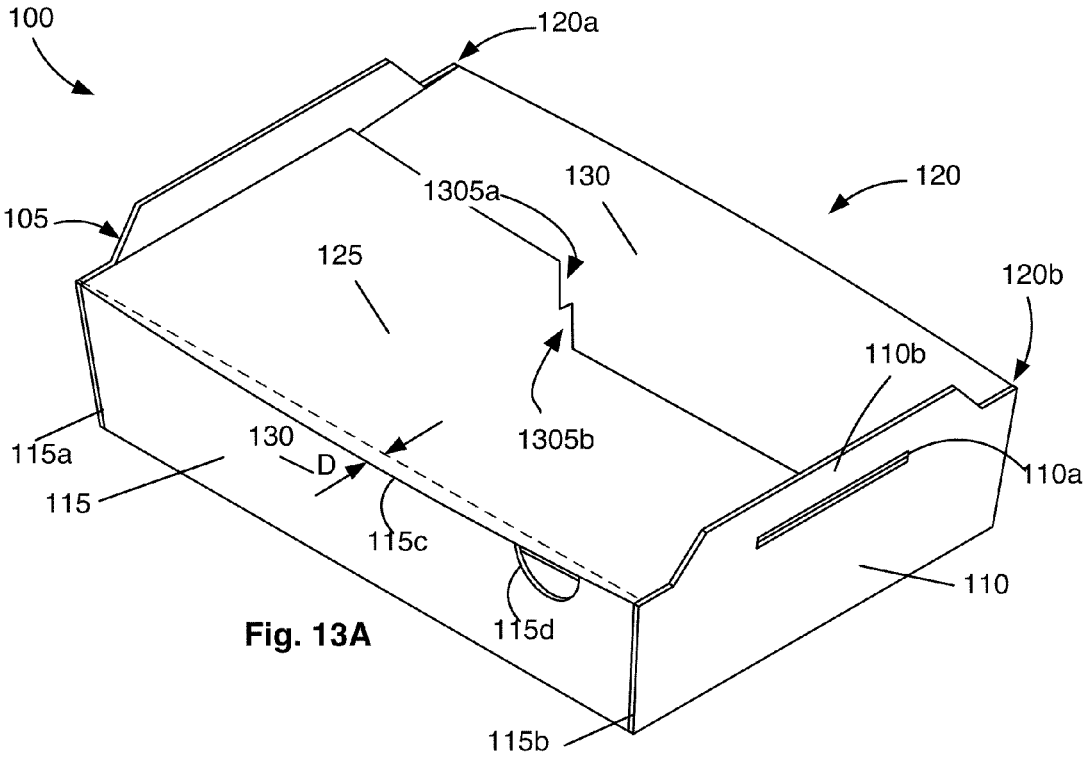
FIG. 13A illustrates a perspective view of an eighth embodiment of a food tray.
Figure 13B:
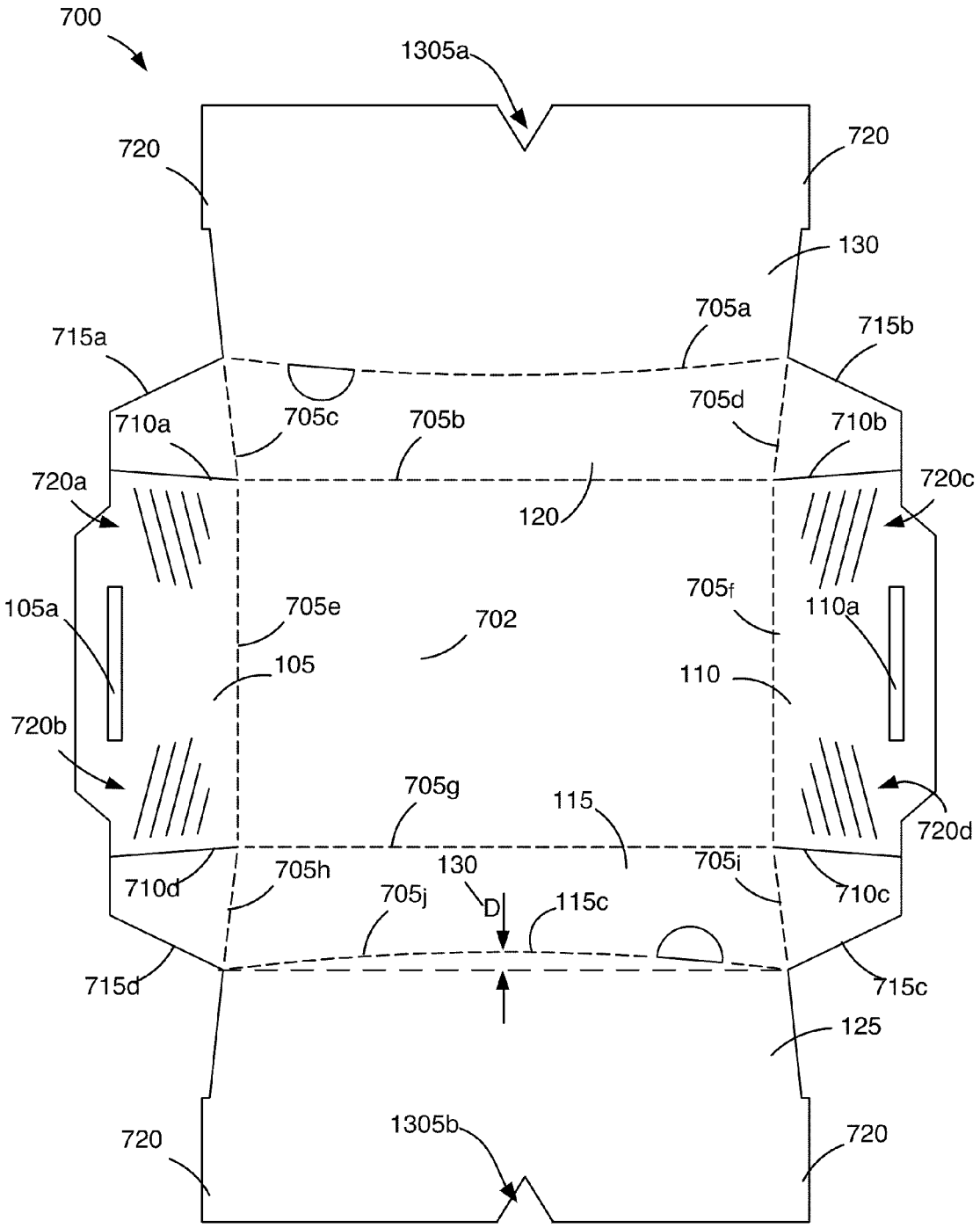
FIG. 13B illustrates the food tray of FIG. 13A in an unassembled configuration.

While various embodiments of the invention have been described, it will be apparent to those of ordinary skill in the art that many more embodiments and implementations are possible that are within the scope of the invention. For example, referring to FIGS. 13*a* and 13*b*, in some embodiments slots 1305*a* and 1305*b* are formed in the first lid member 125 and the second lid member 130. The slots are configured to mesh with one another (FIG. 13A) to facilitate locking of the respective lid members 125 and 130. Locking of the lid members 125 and 130 facilitates a tighter fit between the lid members 125 and 130, thus preventing any slight opening from forming between the respective lid members 125 and 130, due, for example, to board warp. The tighter fit also provides a more visual appealing appearance.

The slots 1305*a* and 1305*b* may have a triangular shape or a different shape that facilities locking of the lid members 125 and 130. The slots 1305*a* and 1305*b* may be positioned along the edge of the respective lid members 125 and 130. The slots 1305*a* and 1305*b* may be provided on any of the food tray embodiments described above.

Figure 14A:
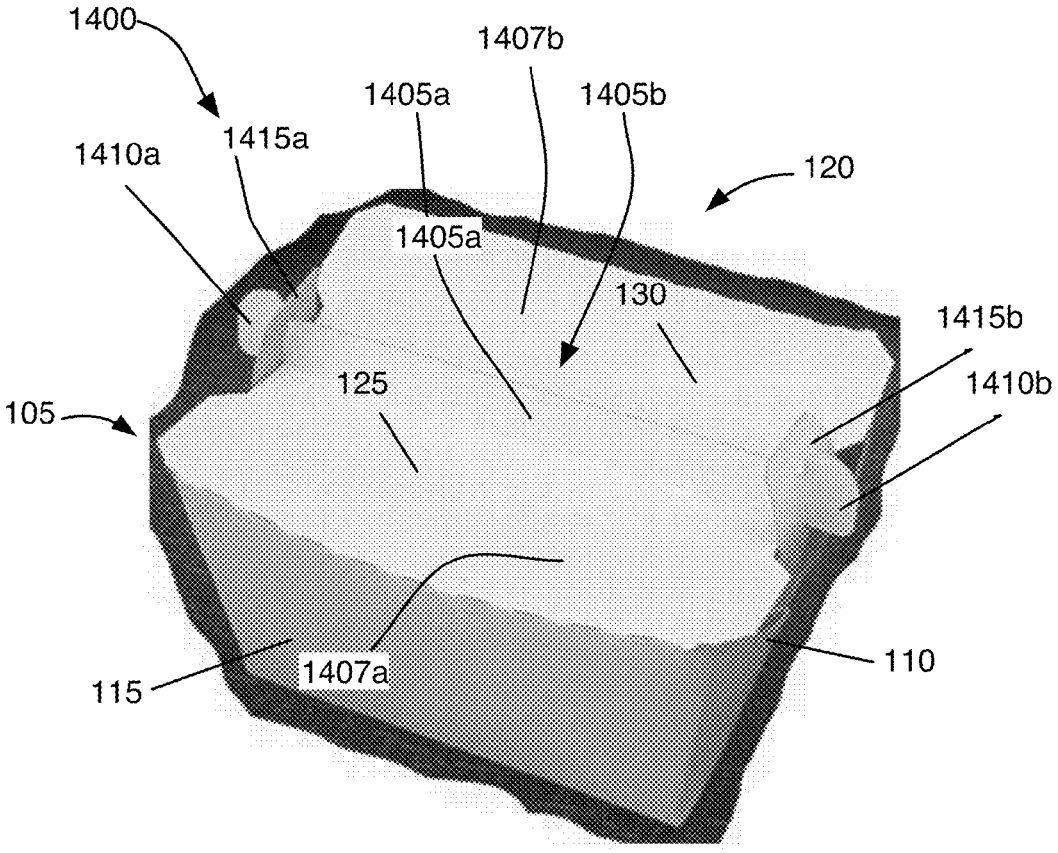
FIG. 14A illustrates a perspective view of a ninth embodiment of a food tray.
Figure 14B:
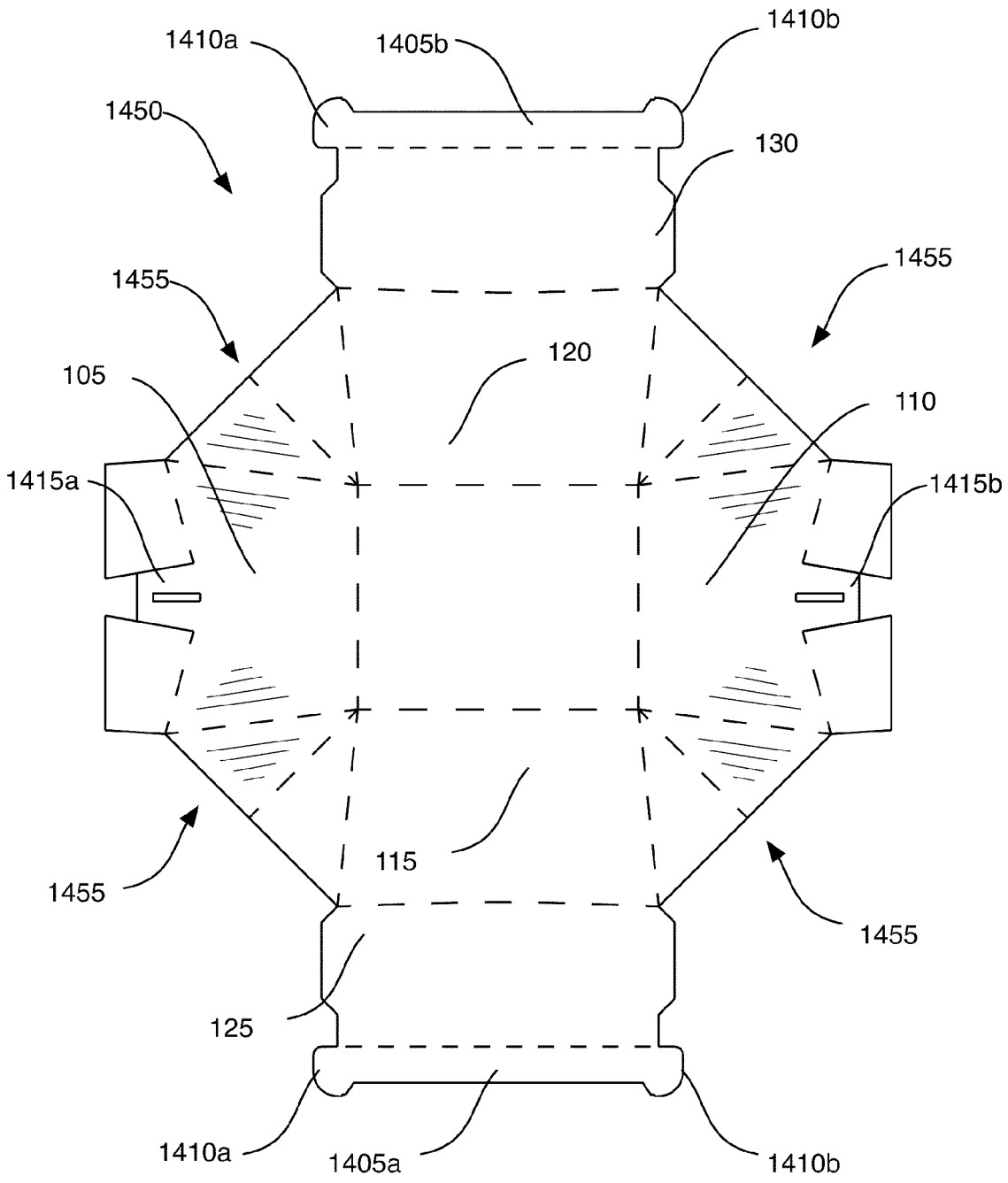
FIG. 14B illustrates the food tray of FIG. 13A in an unassembled configuration.

FIGS. 14A and 14B illustrate yet another embodiment of a food tray 1400. The food tray 1400 includes a first sidewall 105, a second sidewall 110, a front wall 115, a rear wall 120, a first lid member 125, and a second lid member 130. As described above, the first sidewall 105 extends between the respective distal ends of the front wall 115 and the rear wall 120. The second sidewall 110 extends between respective proximal ends the front wall and the rear wall 120.

In some implementations, the first sidewall 105, second sidewall 110, front wall 115, and rear wall 120 may be tapered as described above to enable stacking of the food tray 1400. Other features described with respect to the embodiments described above may be provided.

The first lid member 125 extends from the top edge of the front wall 115, and the second lid member 130 extends from the top edge of the rear wall 120. The first lid member 125 and second lid member 130 each include a horizontal portion 1407*a* and 1407*b* and a flap portion 1405*a* and 1405*b*. Each flap portion 1405*a* and 1405*b* includes first and second tabs 1410*a* and 1410*b*. The first sidewall 105 and second sidewall 110 include an extension member 1415*a* and 1415*b* that define and opening configured to respectively engage the first and second tabs 1410*a* and 1410*b* to lock first lid member 125 and second lid member 130 in a closed configuration. In the closed configuration, the horizontal portions 1407*a* and 1407*b* are configured to substantially close the top of the food tray 1400. Surfaces of the flap portions 1405*a* and 1405*b* are held in contact with one another via the elastic force described above that occurs as a result of the bowing of the front wall 115 and the rear wall 120 to thereby form a vertical rib that extends perpendicular to top of the food tray 1400. The elastic force helps to maintain the surfaces of the flaps 1405*a* and 1405*b* against one another to thereby improve sealing of the food tray 1400.

As illustrated in FIG. 14B, the food tray 1400 may be formed from a single sheet 1450 of material, such as a corrugated paper material. The sheet 1450 may define a group of creases as described above and shown in dashed lines that further define the first side wall 105, second side wall 110, front wall 115, rear wall 120, first lid member 125, second lid member 130, and respective flaps 1405*a* and 1405*b* that define the vertical rib described above. The sheet 1450 may define a group of gussets 1455 for sealing respective corners of the food tray.

Many other modifications may be provided to one or more of the food tray embodiments described above. For example, gusseted sides may or may not be provided. When provided, the gussets may be configured to be positioned inside the food tray or outside the food tray. The respective sheets from which the respective food trays are formed may be made from paperboard or microfluted paperboard coated with a water and/or grease barrier coating or lamination, or an uncoated paperboard or microfluted paperboard. Other modifications may be made without departing from the scope of the claims.

We claim:

1. A food tray comprising:

a front wall with a distal end and a proximal end, and a rear wall with a distal end and a proximal end;

a first side wall that extends between the distal end of the front wall and the distal end of the rear wall, and a second side wall that extends between the proximal end of the front wall and the proximal end of the rear wall, wherein the front wall, rear wall, first side wall, and second side wall define an opening through which an item is placed in the food tray, wherein the first and second side walls each define a slot and an extension extending above the slot;

a lid member that extends from a top edge of the front wall that defines a pair of tabs that engage the slots defined by the first and second side walls when the lid is folded over the opening, wherein the top edge of the front wall is configured to cause the lid member to open when the first and second side wall extensions are pulled apart; and a second lid member that extends from a top edge of the rear wall that defines a pair of tabs that engage the slots defined by the first and second side walls when second lid is folded over the opening, wherein the top edge of the rear wall is configured to cause the second lid member to open when the first and second side wall extensions are pulled apart;

wherein the front wall and the rear wall are bowed when the first lid member and the second lid member are in a closed configuration.

2. The food tray according to claim 1, wherein at least one of the front wall and rear wall defines an opening that enables venting the food tray.

3. The food tray according to claim 1, wherein the front wall, rear wall, first side wall, and second side wall are tapered to enabled the insertion of a second food tray into the opening.

4. The food tray according to claim 1, further comprising a sheet configured to be folded to define the front wall, rear wall, first side wall, second side wall, and the first and second lid members.

5. The food tray according to claim 4, wherein the sheet comprises paperboard or microfluted paperboard coated with a water and/or grease barrier coating or lamination, or an uncoated paperboard or microfluted paperboard.

6. The food tray according to claim 1, further comprising a plurality of gussets formed on respective corners of the food tray.

7. The food tray according to claim 1, wherein the first side wall and the second side wall include respective shelf portions configured to be folded towards a center of the food tray, wherein the respective shelf portions are configured to support at least one of the first and second lid members.

8. A food tray comprising:

a front wall with a distal end and a proximal end, and a rear wall with a distal end and a proximal end;

a first side wall that extends between the distal end of the front wall and the distal end of the rear wall, and a second side wall that extends between the proximal end of the front wall and the proximal end of the rear wall, wherein the front wall, rear wall, first side wall, and second side wall define an opening through which an item is placed in the food tray, wherein the first and second side walls each define a slot and an extension extending above the slot;

a lid member that extends from a top edge of the front wall that defines a pair of tabs that engage the slots defined by the first and second side walls when the lid is folded over the opening, wherein the top edge of the front wall is configured to cause the lid member to open when the first and second side wall extensions are pulled apart;

a second lid member that extends from a top edge of the rear wall that defines a pair of tabs that engage the slots defined by the first and second side walls when second lid is folded over the opening, wherein the top edge of the rear wall is configured to cause the second lid member to open when the first and second side wall extensions are pulled apart; and a first slot positioned on the first lid member and a second slot positioned on the second lid member, wherein the first slot and second slot are configured to engage one another when the food tray is in a closed configuration, wherein the respective slots facilitate locking of the first lid member to the second lid member.

9. A food tray comprising:

a front wall with a distal end and a proximal end, and a rear wall with a distal end and a proximal end;

a first side wall that extends between the distal end of the front wall and the distal end of the rear wall, and a second side wall that extends between the proximal end of the front wall and the proximal end of the rear wall, wherein the front wall, rear wall, first side wall, and second side wall define an opening through which an item is placed in the food tray, wherein the first and second side walls each define a slot and an extension extending above the slot;

a lid member that extends from a top edge of the front wall that defines a pair of tabs that engage the slots defined by the first and second side walls when the lid is folded over the opening, wherein the top edge of the front wall is configured to cause the lid member to open when the first and second side wall extensions are pulled apart;

a plurality of gussets formed on respective corners of the food tray; and a lock tab that extends from on a corner of each of the plurality of gussets configured to engage complementary lock tabs that extend from the first sidewall and the second sidewall.

10. A method of manufacturing a food tray comprising:

creasing a sheet of material to define:

a front wall, a rear wall, a first sidewall, a second sidewall, and a lid member, wherein the lid member and the front wall are separated by a crease that causes the front wall to bow outwardly away from the rear wall when the food tray is assembled and the lid member is folded about the crease to a closed configuration; and forming a first and a second tab on the lid member and a first and a second slot on the first and second side walls, respectively, wherein the first tab and the second tab are configured to engage the first slot and the second slot.

11. The method according to claim 10, further comprising creasing the sheet of material to define a second lid member, wherein the second lid member and the rear wall are separated by another crease that causes the rear wall to bow outwardly away from the front wall when food tray is assembled and the second lid member is folded about the other crease into a closed configuration.

12. The method according to claim 10, further comprising perforating the sheet to define at least one user selectable vent.

13. The method according to claim 12, wherein the user selectable vent is disposed on at least one of the front wall and the rear wall.

14. The method according to claim 10, wherein creases that define the front wall, rear wall, first sidewall, and second sidewall are configured so that when assembled, the food tray is tapered to enable stacking of the food tray.

15. The method according to claim 10, wherein the sheet comprises paperboard or microfluted paperboard coated with a water and/or grease barrier coating or lamination, or an uncoated paperboard or microfluted paperboard.

16. The method according to claim 10, further comprising one or more glue strips disposed on the sheet.

17. The method of claim 10, wherein the crease has an arcuate configuration that curves toward the rear wall portion with the sheet in a flat configuration prior to assembly of the food tray.

18. A food tray comprising:

a front wall with a distal end and a proximal end, and a rear wall with a distal end and a proximal end;

a first side wall that extends between the distal end of the front wall and the distal end of the rear wall, and a second side wall that extends between the proximal end of the front wall and the proximal end of the rear wall, wherein the front wall, rear wall, first side wall, and second side wall define an opening through which an item is placed in the food tray, wherein the first side wall and second side wall define respective extension members, wherein each respective extension member defines a slot; and a first lid member that defines a pair of slots, each slot including a tab that extends from an edge of a respective slot towards a center region of the respective slot;

a second lid member that defines a pair of slots, wherein the first lid member and the second lid member are configured to be folded over one another, and wherein when folded, the respective extension members of the first side wall and the second side wall extend through the respective pair of slots on the first lid member and the second lid member, respectively, and wherein each tab extends through a corresponding slot of the pair of slots defined by each extension member.

19. A food tray comprising:

a front wall with a distal end and a proximal end, and a rear wall with a distal end and a proximal end;

a first side wall that extends between the distal end of the front wall and the distal end of the rear wall, and a second side wall that extends between the proximal end of the front wall and the proximal end of the rear wall, wherein the front wall, rear wall, first side wall, and second side wall define an opening through which an item is placed in the food tray, wherein the first and second side walls each define a slot and an extension extending above the slot; and a first lid member and a second lid member that extend from a top edge of the front wall and a top edge of the rear wall respectively that each define a horizontal portion that substantially forms a closed top of the food tray and a flap portion, the flap portions each configured to form a rib that extends perpendicular to the horizontal portion when the food tray is in a closed configuration, wherein each flap portion includes a pair of tabs that engage the slots defined by the first and second side walls when the first and second lid members are folded over the opening, wherein the top edge of the front wall is configured to cause the first lid member to open when the first and second side wall extensions are pulled apart and to force respective facing surfaces of the flap portions of the first lid member and second lid member against one another to thereby seal the top of the food tray.

20. A food tray, comprising:

a body having a plurality of walls forming an interior space for receiving food therein;

a rear wall of the plurality of body walls;

a bottom wall of the plurality of body walls connected to the rear wall;

a front wall of the plurality of body walls connected to the bottom wall opposite from the rear wall having a top edge;

a lid member that extends from the top edge;

wherein the front wall bows outwardly away from the rear wall when the lid member is shifted about the top edge toward the rear wall to a closed configuration with the lid member extending over the bottom wall;

wherein the lid member comprises a first and a second tab; and first and second side walls of the plurality of body walls and a first and a second slot on the first and second side walls, respectively, wherein the first tab and the second tab are configured to engage the first slot and the second slot.

21. The food tray of claim 20, wherein the rear wall includes a second top edge and a second lid member, and the rear wall bows outwardly away from the front wall when the second lid member is shifted about the top edge toward the front wall into a closed configuration with the second lid member extending over the bottom wall.

22. The food tray of claim 20, wherein the lid member bows inwardly toward the bottom wall when the lid member is shifted about the top edge into the closed configuration.

* * * * *